US010854361B2

(12) United States Patent
Hirata et al.

(10) Patent No.: US 10,854,361 B2
(45) Date of Patent: Dec. 1, 2020

(54) THERMISTOR ELEMENT AND MANUFACTURING METHOD THEREFOR

(71) Applicant: Murata Manufacturing Co., Ltd., Nagaokakyo (JP)

(72) Inventors: Yuichi Hirata, Nagaokakyo (JP); Kengo Mito, Nagaokakyo (JP); Kojiro Tokieda, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/839,141

(22) Filed: Apr. 3, 2020

(65) Prior Publication Data

US 2020/0234856 A1 Jul. 23, 2020

Related U.S. Application Data

(63) Continuation of application No. PCT/JP2018/038593, filed on Oct. 17, 2018.

(30) Foreign Application Priority Data

Nov. 2, 2017 (JP) ..... 2017-213106
Nov. 2, 2017 (JP) ..... 2017-213109

(51) Int. Cl.
*H01C 1/14* (2006.01)
*H01C 7/04* (2006.01)
*H01C 17/28* (2006.01)

(52) U.S. Cl.
CPC ..... *H01C 1/1413* (2013.01); *H01C 7/04* (2013.01); *H01C 17/281* (2013.01)

(58) Field of Classification Search
CPC ..... H01C 1/1413; H01C 7/04; H01C 17/281
See application file for complete search history.

(56) References Cited

U.S. PATENT DOCUMENTS 5,750,264 A * 5/1998 Ueno ..... C04B 35/47 428/426
8,669,841 B2 * 3/2014 Miura ..... H01C 7/043 338/22 R (Continued)

FOREIGN PATENT DOCUMENTS

JP 08-236308 A 9/1996
JP 2004-087717 A 3/2004

(Continued)

OTHER PUBLICATIONS

JP 05-258906, Numata et al., machine translation. (Year: 1993).*

(Continued)

*Primary Examiner* — Kyung S Lee
(74) *Attorney, Agent, or Firm* — Keating & Bennett, LLP

(57) ABSTRACT

A thermistor element includes an element body made of ceramic and including first and second end surfaces opposite to each other and a peripheral surface located between the first end surface and the second end surface, first and second external electrodes respectively covering the first and second end surfaces and portion of the peripheral surface adjacent to the respective first and second end surfaces. The first and second external electrodes include electrode layers including an underlayer and a metal plating layer, the underlayer of the first external electrode includes, adjacent to or in a vicinity of the second external electrode, two second external electrode side corner portions that are thin and adjacent to each other, and the underlayer of the second external electrode includes, adjacent to or in a vicinity of the first external electrode, two first external electrode side corner portions that are thin and adjacent to each other.

17 Claims, 5 Drawing Sheets

(56) References Cited

U.S. PATENT DOCUMENTS

| | | | | |
|---|---|---|---|---|
| 2006/0202794 | A1* | 9/2006 | Ho | H01C 7/027 338/220 |
| 2008/0048821 | A1* | 2/2008 | Miura | H01C 7/041 338/22 SD |
| 2017/0011852 | A1* | 1/2017 | Miyazaki | H01G 4/30 |
| 2017/0186538 | A1* | 6/2017 | Ando | H01G 4/2325 |
| 2017/0207009 | A1* | 7/2017 | Miyata | C04B 35/453 |
| 2020/0082985 | A1* | 3/2020 | Suga | H01G 4/2325 |

FOREIGN PATENT DOCUMENTS

| | | | |
|---|---|---|---|
| JP | 2005-005373 | A | 1/2005 |
| JP | 2005-251993 | A | 9/2005 |
| JP | 2012-216699 | A | 11/2012 |

OTHER PUBLICATIONS

JP 2005-251993, Takeuchi et al., machine translation. (Year: 2005).*
Official Communication issued in International Patent Application No. PCT/JP2018/038593, dated Jan. 8, 2019.

* cited by examiner

THERMISTOR ELEMENT AND MANUFACTURING METHOD THEREFOR

CROSS REFERENCE TO RELATED APPLICATIONS

This application claims the benefit of priority to Japanese Patent Application No. 2017-213109 filed on Nov. 2, 2017 and Japanese Patent Application No. 2017-213106 filed on Nov. 2, 2017, and is a Continuation Application of PCT Application No. PCT/JP2018/038593 filed on Oct. 17, 2018. The entire contents of each application are hereby incorporated herein by reference.

BACKGROUND OF THE INVENTION

1. Field of the Invention

The present invention relates to a thermistor element and a manufacturing method therefor, and more particularly, to a thermistor element which is suitable for wire bonding and a manufacturing method therefor.

2. Description of the Related Art

In recent years, with the growing demand for a reduction in the size of electronic devices, electronic components such as thermistor elements have been progressively reduced in size and height. FIG. 7 is a sectional view showing an example of the structure of a chip-type thermistor element 100. An upper surface electrode layer 102*a* is provided on an upper surface 101*a* of a thermistor body 101, and a lower surface electrode layer 102*b* is provided on a lower surface 101*b* of the thermistor body 101, and wire bonding regions 103*b* and solder patterns 103 are formed on the surfaces of the respective electrodes 102*a*, 102*b* (for example, Japanese Patent Application Laid-Open No. 2005-5373). For mounting the thermistor element 100, the lower surface electrode layer 102*b* is electrically connected to an electronic device with a submount interposed therebetween by melting the solder pattern 103, and a wire is bonded to the wire bonding region 103*b*.

However, the chip-type thermistor element in the conventional wire bonding specification has a problem of insufficiently addressing the demand for the reduction in size and height. In addition, there is also a need to further improve the reliability of wire bonding.

SUMMARY OF THE INVENTION

Preferred embodiments of the present invention provide thermistor elements and manufacturing methods therefor, which are each able to reduce a size and a height of the thermistor element, while also significantly increasing a reliability of wire bonding.

A thermistor element according to a preferred embodiment of the present invention includes an element body made of a ceramic and including first and second end surfaces opposite to each other and a peripheral surface located between the first end surface and the second end surface; a first external electrode covering the first end surface and a portion of the peripheral surface adjacent to or in a vicinity of the first end surface; and a second external electrode covering the second end surface and a portion of the peripheral surface adjacent to or in a vicinity of the second end surface, wherein each of the first external electrode and the second external electrode includes a plurality of electrode layers including an underlayer that is a lowermost layer and a metal plating layer that is an uppermost layer, the underlayer of the first external electrode includes, adjacent to or in a vicinity of the second external electrode, two second external electrode side corner portions that are thin and adjacent to each other, and the underlayer of the second external electrode includes, adjacent to or in a vicinity of the first external electrode, two first external electrode side corner portions that are thin and adjacent to each other.

According to the features described above, thin portions of the underlayers absorb internal stress of the metal plating layers, thus significantly reducing or preventing the external electrodes from peeling off and significantly reducing or preventing cracks from being generated.

In addition, according to a preferred embodiment of the present invention, the underlayer of the first external electrode includes a thin first edge portion connected to the two second external electrode side corner portions, and the underlayer of the second external electrode includes a thin second edge portion connected to the two first external electrode side corner portions.

According to the features described above, the underlayers include the first edge portion and the second edge portion, thus significantly reducing or preventing the external electrodes from peeling off and significantly reducing or preventing cracks from being generated.

In addition, according to a preferred embodiment of the present invention, the underlayers include a hardened conductive paste.

According to the features described above, it is possible to prevent the underlayers including the hardened conductive paste from peeling off and prevent cracks from being generated.

In addition, according to a preferred embodiment of the present invention, the first external electrode includes an arcuate recess where a central portion is recessed toward the first end surface in plan view, and the second external electrode includes an arcuate recess where a central portion is recessed toward the second end surface in plan view.

According to the features described above, the first external electrode and the second external electrode are able to be prevented from being short-circuited.

In addition, according to a preferred embodiment of the present invention, each of the first external electrode and the second external electrode includes, in plan view, a pair of end sides that intersect a length direction extending from the first end surface toward the second end surface, and a pair of sides along the length direction, and relationships of $L1<E1$ and $L2<E2$ are met, where L1 and L2 respectively denote the lengths between the pairs of end sides in the central portions of the first external electrode and the second external electrode, and E1 and E2 respectively denote the lengths of the sides of the first external electrode and the second external electrode.

According to the features described above, the first external electrode and the second external electrode are able to be prevented from being in contact with each other, even when the thermistor element is reduced in size and height. In addition, since the central portions of the first external electrode and the second external electrode are able to be made flat or substantially flat, the adhesion to wire is able to be significantly increased and thus the reliability of wire bonding is able to be significantly increased.

In addition, according to a preferred embodiment of the present invention, the L1 and the L2 are about 95 μm or more and about 285 μm or less, and the E1 and the E2 are about 100 μm or more and about 290 μm or less.

According to the features described above, the thermistor element is able to be used as a thermistor element that has a 0603 size in accordance with JIS (Japanese Industrial Standards) and a thermistor element that has a size smaller than the 0603 size.

In addition, according to a preferred embodiment of the present invention, the L1 and the E1 and the L2 and the E2 respectively satisfy the relationships of about 0.770≤(L1/E1)≤about 0.975 and about 0.770≤(L2/E2)≤about 0.975.

According to the features described above, it is possible to prevent the first external electrode and the second external electrode from being in contact with each other, while securing the flatness of the central portions of the first external electrode and the second external electrode.

In addition, according to a preferred embodiment of the present invention, adjacent corners of the first external electrode adjacent to or in a vicinity of the first end surface have a round shape, and adjacent corners of the second external electrode adjacent to or in a vicinity of the second end surface have a round shape.

According to the features described above, the corners are able to be prevented from being cracked or chipped, thus further significantly increasing the reliability of wire bonding.

Furthermore, the thermistor elements according to the features described above are able to be manufactured by a manufacturing method including an element body preparation step of preparing the element body; and an external electrode preparation step of preparing the first external electrode and the second external electrode, where the external electrode preparation step further includes an underlayer formation step of further forming underlayers, and the underlayer formation step includes forming two second external electrode side corner portions, which are thin and adjacent to each other, of the underlayer of the first external electrode adjacent to or in a vicinity of the second external electrode, and forming two first external electrode side corner portions, which are thin and adjacent to each other, of the underlayer of the second external electrode adjacent to or in a vicinity of the first external electrode.

The manufacturing method described above is able to manufacture a thermistor element that significantly reduces or prevents the external electrodes from peeling off and significantly reduces or prevents cracks from being generated.

In addition, in the manufacturing method according to a preferred embodiment of the present invention, the underlayer of the first external electrode is provided with a thin first edge portion connected to the two second external electrode side corner portions, and the underlayer of the second external electrode is provided with a thin second edge portion connected to the two first external electrode side corner portions.

According to the features described above, it is possible to further prevent the external electrodes from peeling off and prevent cracks from being generated.

In addition, in the manufacturing method according to a preferred embodiment of the present invention, the underlayer formation step includes applying an electrode paste to the element body by a dipping process, and baking the electrode paste to form the underlayers, and the lengths between pairs of end sides in central portions of the underlayers of the first external electrode and the second external electrode are smaller than the lengths of sides of the underlayers.

According to the features described above, the first external electrode and the second external electrode are able to be prevented from being in contact with each other, and a thermistor element is able to be provided in which the first external electrode and the second external electrode have flat or substantially flat central portions.

The preferred embodiments of the present invention provide thermistor elements which are each able to reduce a size and a height of the thermistor element, while significantly increasing a reliability of wire bonding.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

The present invention will be described in detail below with reference to preferred embodiments and the drawings. It is to be noted that in the following description of the preferred embodiments and the drawings, the same or similar components will be denoted by the same reference symbols, and repeated descriptions will be omitted.

A thermistor element according to a preferred embodiment of the present invention includes an element body made of a ceramic and including first and second end surfaces opposite to each other and a peripheral surface located between the first end surface and the second end surface; a first external electrode covering the first end surface and a portion of the peripheral surface adjacent to or in a vicinity of the first end surface; and a second external electrode covering the second end surface and a portion of the peripheral surface adjacent to or in a vicinity of the second end surface, where each of the first external electrode and the second external electrode includes a plurality of electrode layers including an underlayer that is a lowermost layer and a metal plating layer that is an uppermost layer, the underlayer of the first external electrode includes, adjacent to or in a vicinity of the second external electrode, two second external electrode side corner portions that are thin and adjacent to each other, and the underlayer of the second external electrode includes, adjacent to or in a vicinity of the first external electrode, two first external electrode side corner portions that are thin and adjacent to each other.

Figure 1:
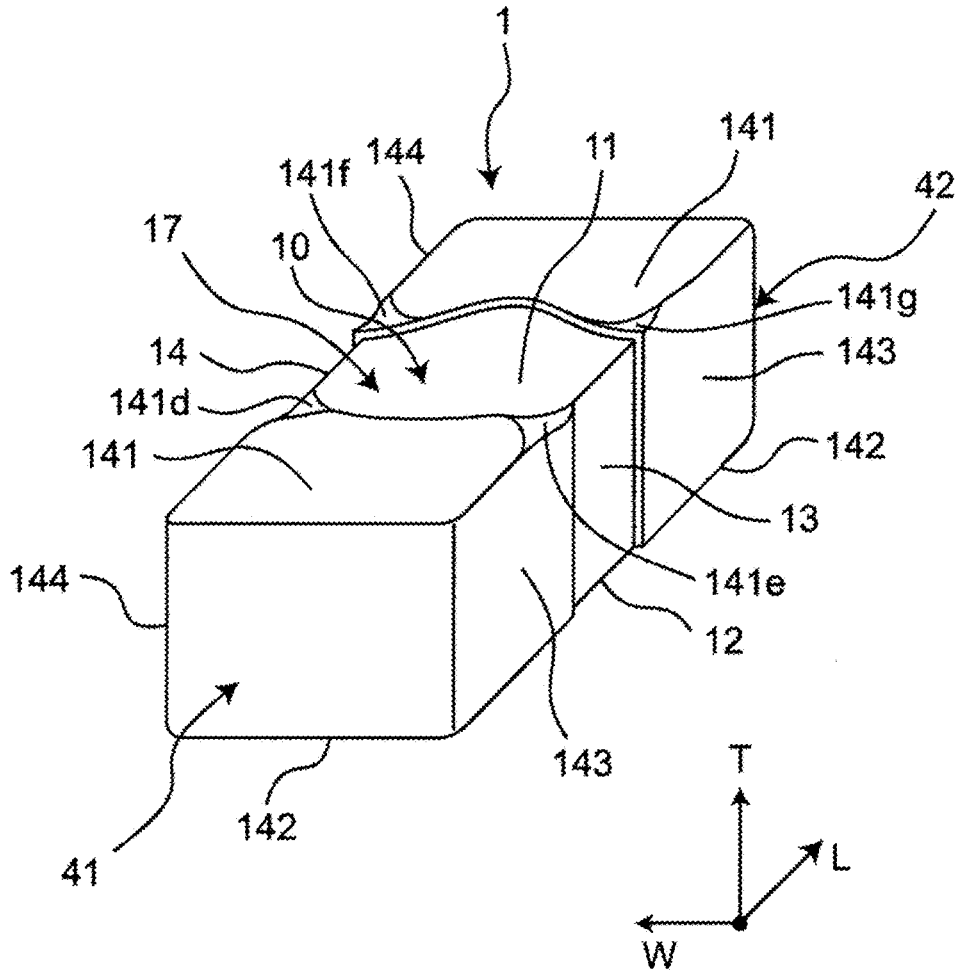
FIG. 1 is a perspective view showing the structure of a thermistor element according to a preferred embodiment of the present invention.
Figure 2:
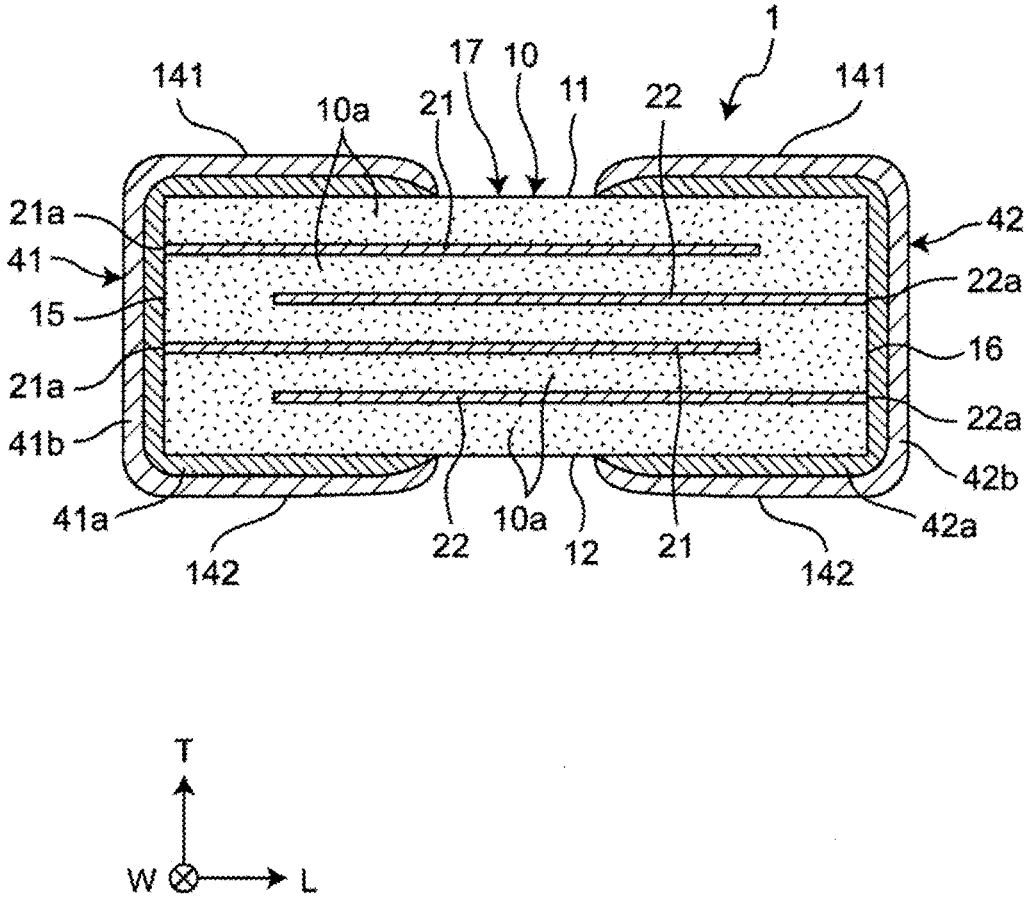
FIG. 2 is a sectional view of the thermistor element in FIG. 1.
Figure 3:
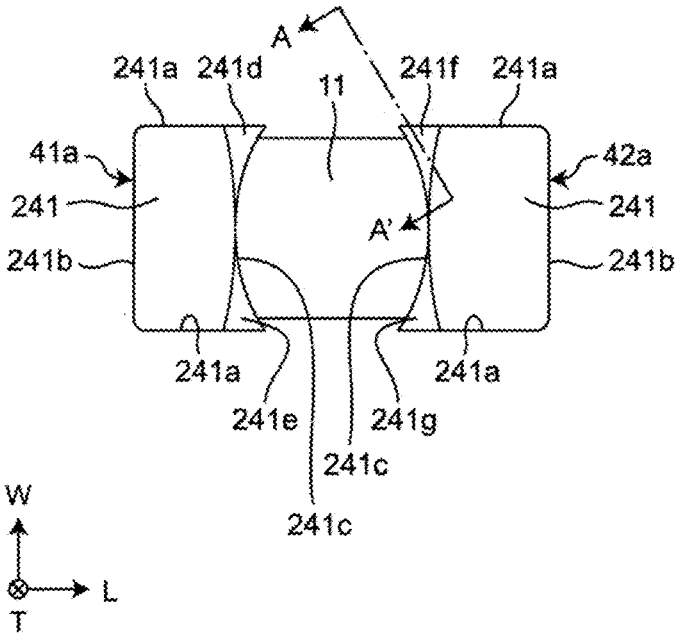
FIG. 3 is a plan view of the thermistor element in FIG. 1.
Figure 4:
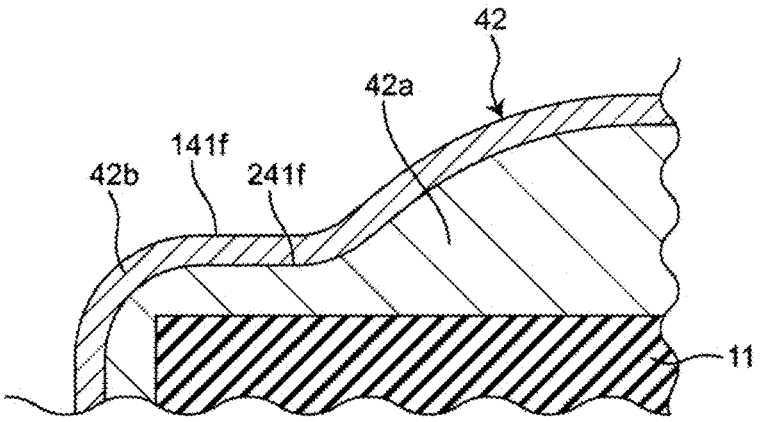
FIG. 4 is a partial sectional view taken along line A-A' of FIG. 3.

FIG. 1 is a perspective view showing an example of the structure of a thermistor element 1 according to the present preferred embodiment. FIG. 2 is a sectional view of the thermistor element 1. FIG. 3 is a plan view of the thermistor element 1 excluding metal plating layers. FIG. 4 is a partial longitudinal sectional view taken along line A-A' in FIG. 3.

The thermistor element 1 includes an element body 10, internal electrodes 21, 22 provided in the element body 10, and first and second external electrodes 41, 42 that cover a portion of the surface of the element body 10 and are electrically connected to the internal electrodes 21, 22.

The element body 10 includes a plurality of laminated ceramic layers 10*a*. The ceramic layers 10*a* are preferably made of, for example, a ceramic that has negative resistance temperature characteristics. The ceramic is preferably, for example, a ceramic including a manganese oxide as its main component, and includes a nickel oxide, a cobalt oxide, alumina, an iron oxide, a titanium oxide, a zirconium oxide, a copper oxide, a zinc oxide, or the like. More specifically, the thermistor element 1 is preferably an NTC (Negative Temperature Coefficient) thermistor, which has a resistance value that decreases with an increase in temperature.

The element body 10 has a cuboid or substantially cuboid shape. The surface of the element body 10 includes a first end surface 15 and a second end surface 16 located opposite to each other, and a peripheral surface 17 located between the first end surface 15 and the second end surface 16. The first end surface 15 and the second end surface 16 are parallel or substantially parallel. The peripheral surface 17 includes a first side surface 11, a second side surface 12, a third side surface 13, and a fourth side surface 14. The first side surface 11 and the second side surface 12 are located in the direction in which the ceramic layers 10*a* are laminated, and located opposite to each other. The third side surface 13 and the fourth side surface 14 are located opposite to each other. The first side surface 11 and the second side surface 12 are parallel Or substantially parallel. The third side surface 13 and the fourth side surface 14 are parallel or substantially parallel. The first end surface 15, the first side surface 11, and the third side surface 13 are perpendicular or substantially perpendicular to each other. It is to be noted that the element body 10 may be shaped to have chamfered corners and ridges.

In this regard, the length direction of the thermistor element 1 extending from the first end surface 15 toward the second end surface 16 is referred to as an L direction, and the width direction of the thermistor element 1 extending from the third side surface 13 toward the fourth side surface 14 is referred to as a W direction, and the thickness direction of the thermistor element 1 extending from the second side surface 12 toward the first side surface 11 is referred to as a T direction. The L direction, the W direction, and the T direction are perpendicular or substantially perpendicular to each other. Specifically, the L direction is a direction perpendicular or substantially perpendicular to the first end surface 15, the W direction is a direction perpendicular or substantially perpendicular to the third side surface 13, and the T direction is a direction perpendicular or substantially perpendicular to the first side surface 11.

The internal electrodes 21, 22 are laminated alternately with the ceramic layers 10*a*. The internal electrodes 21, 22 preferably include, for example, at least one element or compound of Ag, Pd, and AgPd.

The two internal electrodes 21, 22 adjacent to each other are provided in parallel or substantially in parallel with the ceramic layer 10*a* provided therebetween. As for the two internal electrodes 21, 22 adjacent to each other, the first internal electrode 21 includes an end 21*a* exposed from the first end surface 15 of the element body 10, and the second internal electrode 22 includes an end 22*a* exposed from the second end surface 16 of the element body 10.

The first external electrode 41 covers the first end surface 15, and the peripheral surface 17 adjacent to or in a vicinity of the first end surface 15. The first external electrode 41 is in contact with and electrically connected to the end 21*a* of the first internal electrode 21. The first external electrode 41 is provided to face the peripheral surface 17 in the peripheral direction. For example, as shown in FIG. 1, the first external electrode 41 is provided to face the entire or substantially the entire periphery in the peripheral direction of the peripheral surface 17. More specifically, the first external electrode 41 includes a first surface 141, a second surface 142, a third surface 143, and a fourth surface 144 opposed to the first side surface 11, the second side surface 12, the third side surface 13, and the fourth side surface 14 in this order. The first surface 141 to the fourth surface 144 refer to portions extending along the peripheral surface 17. More specifically, the first surface 141 to the fourth surface 144 extend from one end surface of the first external electrode 41 to the other end surface of the first external electrode 41 in the L direction. Alternatively, the first external electrode 41 may be provided on some surfaces of the peripheral surface 17. For example, the first external electrode 41 may cover the first end surface 15 and include the first surface 141 and the second face 142, that is, the first external electrode 41 may have a U-shaped cross section. Alternatively, the first external electrode 41 may cover the first end surface 15 and include only the first surface 141, that is, the first external electrode 41 may have an L-shaped cross section.

In addition, the second external electrode 42 covers the second end surface 16, and the peripheral surface 17 adjacent to or in a vicinity of the second end surface 16. The second external electrode 42 is in contact with and electrically connected to the end 22*a* of the second internal electrode 22. The second external electrode 42 is provided to face the entire or substantially the entire periphery in the peripheral direction of the peripheral surface 17. For example, as shown in FIG. 1, the second external electrode 42 is provided to face the entire periphery in the peripheral direction of the peripheral surface 17. More specifically, the second external electrode 42 has the first surface 141, the second surface 142, the third surface 143, and the fourth surface 144 opposed to the first side surface 11, the second side surface 12, the third side surface 13, and the fourth side surface 14 in this order. The first surface 141 to the fourth surface 144 refer to portions extending along the peripheral surface 17. More specifically, the first surface 141 to the fourth surface 144 extend from one end surface of the second external electrode 42 to the other end surface thereof in the L direction. Alternatively, the second external electrode may be provided on some surfaces of the peripheral surface 17. For example, the second external electrode 42 may cover the second end surface 16 and include the first surface 141 and the second surface 142, that is, the second external electrode 42 may have a U-shaped cross section. Alternatively, the second external electrode 42 may cover the second end surface 16 and include only the first surface 141, that is, the second external electrode 42 may have an L-shaped cross section.

Further, as shown in FIG. 1, the first surface 141 of the first external electrode 41 includes, adjacent to or in a vicinity of the second external electrode, two second external electrode side corner portions 141*d*, 141*e* which are thin and adjacent to each other. Similarly, the first surface 141 of the second external electrode 42 includes, adjacent to or in a vicinity of the first external electrode, two first external electrode side corner portions 141*f*, 141*g* which are thin and adjacent to each other. The second external electrode side corner portions and the first external electrode side corner portions are thinner than the regions of the external electrodes other than the corner portions. In this regard, the corner portion includes a peripheral region at a corner that is the intersection of an end side and a side which intersect each other, among pairs of end sides of the first external electrode and the second external electrode, which intersect the length direction of the thermistor element 1 extending from the first end surface 15 toward the second end surface 16, and pairs of sides of the first external electrode and the second external electrode along the length direction. In addition, in a case where the peripheral region of the corner is chamfered, the chamfered region is included in the corner portion.

FIG. 3 is a plan view of the thermistor element 1 in which metal plating layers are removed from the external electrodes. First surfaces 241 of an underlayer 41*a* of the first external electrode 41 and an underlayer 42*a* of the second external electrode 42 each have, in plan view, a pair of end sides 241*b*, 241*c* that intersect the length direction (L direction) extending from the first end surface 15 toward the second end surface 16, and a pair of sides 241*a*, 241*a* along the length direction. The length between the pair of end sides 241*b*, 241*c* in the central portion of the underlayer 41*a* is smaller than the length of the side 241*a* of the underlayer 41*a*. Similarly, the length between the pair of end sides 241*b*, 241*c* in the central portion of the underlayer 42*a* is smaller than the length of the side 241*a* of the underlayer 42*a*. For example, as shown in FIG. 3, the underlayer 41*a* may have an arcuate recess where the central portion of the first surface 241 is recessed toward the first end surface in plan view, and the underlayer 42*a* may have an arcuate recess where the central portion of the first surface 241 is recessed toward the second end surface in plan view. In this regard, the central portion of the first surface 241 refers to a region including the respective midpoints of a pair of opposed end sides in the length direction extending from the first end surface 15 toward the second end surface 16.

The underlayer 41*a* of the first external electrode 41 includes, adjacent to or in a vicinity of the second external electrode 42, two second external electrode side corner portions 241*d*, 241*e* which are thin and adjacent to each other. Similarly, the underlayer 42*a* of the second external electrode 42 includes, adjacent to or in a vicinity of the first external electrode 41, two first external electrode side corner portions 241*f*, 241*g* which are thin and adjacent to each other. In this regard, each of the second external electrode side corner portions 241*d*, 241*e* and the first external electrode side corner portions 241*f*, 241*g* includes a peripheral region at a corner that is the intersection of an end side and a side which intersect each other, among pairs of end sides of the underlayers 41*a* and 42*a* and pairs of sides of the underlayers 41*a* and 42*a*. Further, also as for the second surface (not shown) opposite to the first surface 241, the underlayer 41*a* includes, adjacent to or in a vicinity of the second external electrode 42, two second external electrode side corner portions (not shown) which are thin and adjacent to each other, and also the underlayer 42*a* includes, adjacent to or in a vicinity of the first external electrode 41, two first external electrode side corner portions (not shown) which are thin and adjacent to each other.

FIG. 4 is a partial sectional view taken along line A-A' of FIG. 3. The underlayer 42*a* includes the thin corner portion 241*f*, and a metal plating layer 42*b* is provided on the underlayer 42*a*. Thus, the second external electrode, on the whole, also has the thin corner portion 141*f*.

The first external electrode 41 and the second external electrode 42 include a plurality of electrode layers of which the outermost layer is a metal plating layer. FIG. 2 shows an example in which the first external electrode 41 and the second external electrode 42 include the underlayer 41*a*, 42*a* and the metal plating layer 41*b*, 42*b* from the bottom. An intermediate layer may also be provided between the underlayer and the metal plating layer. The underlayer, the intermediate layer, and the metal plating layer may be single layers or each of the underlayer, the intermediate layer, and the metal plating layer may include a plurality of layers. The underlayer defines and functions as a layer that covers the element body 10, for which, for example, Ni may preferably be used. Further, the intermediate layer defines and functions as a layer that significantly reduces or prevents the thermal diffusion of the metal of the underlayer, for which, for example, Pd may preferably be used in a case where Ni is used for the underlayer. Gold, silver, copper, and the like, for example, may be used for the metal plating layer. The underlayer and the intermediate layer are able to be formed by a sputtering method, a printing method, a dipping method, or the like, for example. In addition, the metal plating layer is able to be formed by an electrolytic plating method, for example.

In the case of forming the plating layer on the underlayer, there is a problem in that internal stress of the plating layer causes an end of the plating layer to peel off or crack at the end. In particular, when attempting to make the underlayer thin from the viewpoint of reducing the size and height of the thermistor element, the corner portions are more likely to be peeled off and become cracked. The thermistor element according to the present preferred embodiment causes the thin corner portions of underlayers to absorb internal stress of the metal plating layers, thus significantly reducing or preventing the external electrodes from peeling off and significantly reducing or preventing cracks from being generated. Accordingly, the reliability of wire bonding is able to be significantly increased.

Although the size of the thermistor element is not particularly limited, for example, the thermistor element is able to be used as a thermistor element that has a 0603 size in accordance with JIS or a thermistor element that has a size smaller than the 0603 size. In this regard, the 0603 size in accordance with JIS is (0.6±0.03) mm (L direction)× (0.3±0.03) mm (W direction).

In this regard, the thickness of the thin corner portion of the underlayer has only to be smaller than the thickness of the underlayer other than the thin corner portion, and for example, in a case where the average thickness of the underlayer other than the thin corner portion is about 4 μm or more and about 14 μm or less, the average thickness of the thin corner portion is preferably about 1 μm or more and about 10 μm or less, and more preferably about 2 μm or more and about 7 μm or less.

Further, as shown in FIG. 1, in the length direction (L direction) extending from the first end surface 15 to the second end surface 16, preferably, for example, the first external electrode 41 of the thermistor element includes an arcuate recess where the central portion of the first surface 141 is recessed toward the first end surface in plan view, and the second external electrode 42 includes an arcuate recess where the central portion of the first surface 141 is recessed toward the second end surface in plan view. When the thermistor element is reduced in size, the distance between the first external electrode and the second external electrode is reduced, thus possibly causing a short circuit between the first external electrode and the second external electrode. However, the short circuit is able to be prevented by providing the central portions of the first surfaces 141 with the arcuate recesses. In this regard, the central portion of the first surface 141 refers to a region including the respective midpoints of a pair of opposed end sides in the length direction extending from the first end surface 15 toward the second end surface 16.

Figure 5:
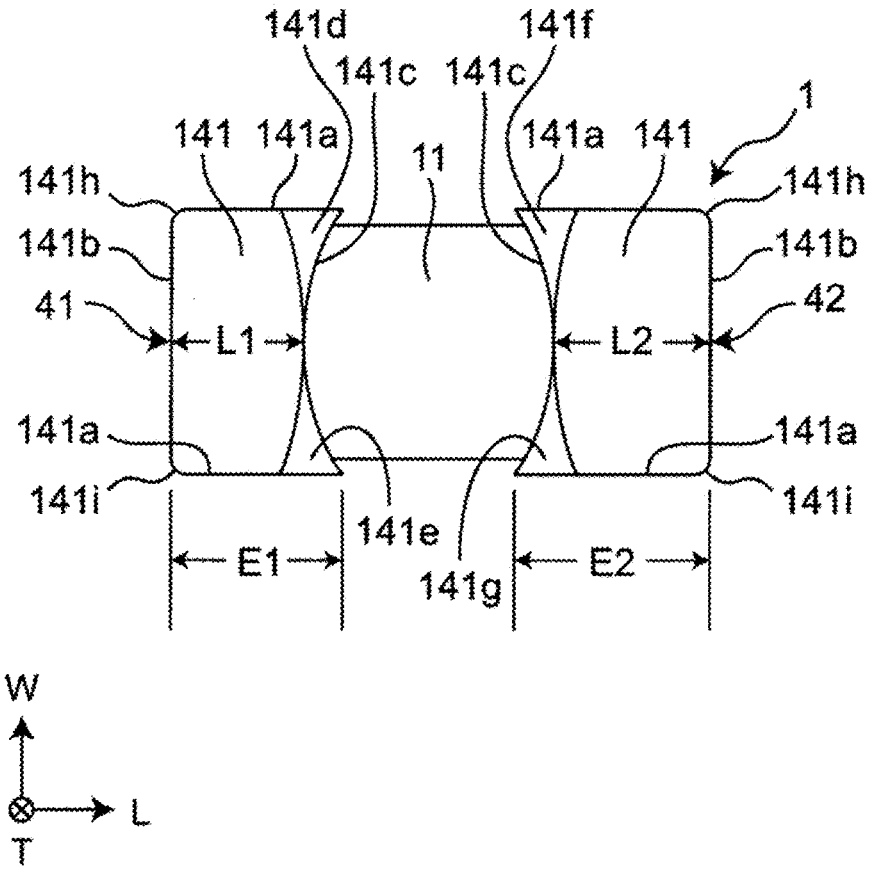
FIG. 5 is a plan view of a thermistor element according to another preferred embodiment of the present invention.

Further, as shown in FIG. 5, each of the first external electrode 41 and the second external electrode 42, in plan view, includes a pair of end sides 141*b*, 141*c* that intersect the length direction (L direction) extending from the first end surface 15 toward the second end surface 16, and a pair of sides 141*a*, 141*a* along the length direction. In a case where the lengths between the pairs of end sides in the central portions of the first external electrode 41 and the second external electrode 42 are respectively denoted by L1 and L2, and the lengths of the sides 141*a* of the first external electrode 41 and the second external electrode 42 are respectively denoted by E1 and E2, the relationships of L1<E1 and L2<E2 are preferably satisfied, for example. In this regard, the central portion of the first external electrode 41 or the second external electrode 42 refers to a region including the respective midpoints of a pair of opposed end sides in the length direction extending from the first end surface 15 toward the second end surface 16.

In this regard, the length between both the end sides 141*b* and 141*c* in the central portion of the first external electrode 41 (hereinafter, also referred to as the length of the central portion of the first external electrode 41) refers to the average value of the length between the end sides 141*b* and 141*c* in the central portions of the first surface 141 and second surface 142, in a case where the first external electrode 41 is provided to face the entire or substantially the entire periphery in the peripheral direction of the peripheral surface 17, and in a case where the first external electrode 41 is provided to cover the first end surface 15 and have the first surface 141 and the second surface 142. In addition, in a case where the first external electrode 41 covers the first end surface 15 and includes only the first surface 141, the foregoing length refers to the length between the both end sides 141*b* and 141*c* in the central portion of the first surface 141. Similarly, the length between both the end sides 141*b* and 141*c* in the central portion of the second external electrode 42 (hereinafter, also referred to as the length of the central portion of the second external electrode 42) refers to the average value of the length between the end sides 141*b* and 141*c* in the central portions of the first surface 141 and second surface 142, in a case where the second external electrode 42 is provided to face the entire or substantially the entire periphery in the peripheral direction of the peripheral surface 17, and in a case where the second external electrode 42 is provided to cover the second end surface 16 and include the first surface 141 and the second surface 142. In addition, in a case where the second external electrode 42 covers the second end surface 16 and includes only the first surface 141, the foregoing length refers to the length between the both end sides 141*b* and 141*c* in the central portion of the first surface 141.

Further, the length E1 of the side 141*a* of the first external electrode 41 refers to the average value of the four sides of the first surface 141 and the second surface 142, in a case where the first external electrode 41 is provided to face the entire or substantially the entire periphery in the peripheral direction of the peripheral surface 17, and in a case where the first external electrode 41 is provided to cover the first end surface 15 and include the first surface 141 and the second surface 142. In addition, in a case where the first external electrode 41 covers the first end surface 15 and includes only the first surface 141, the length E1 refers to the average value of the two sides of the first surface 141. Similarly, the length E2 of the side 141*a* of the second external electrode 42 refers to the average value of the four sides of the first surface 141 and the second surface 142, in a case where the second external electrode 42 is provided to face the entire or substantially the entire periphery in the peripheral direction of the peripheral surface 17, and in a case where the second external electrode 42 is provided to cover the second end surface 16 and include the first surface 141 and the second surface 142. In addition, in a case where the second external electrode 42 covers the second end surface 16 and includes only the first surface 141, the length E2 refers to the average value of the two sides of the first surface 141.

In a case where the thermistor element is reduced in size and height, the interval between the first external electrode and the second external electrode is narrowed, thus increasing a likelihood of a short circuit. On the other hand, the relationships of L1<E1 and L2<E2 are satisfied, that is, the lengths of the central portions of the first external electrode and the second external electrode are smaller than the lengths of the sides, thus preventing contact between the first external electrode and the second external electrode. In addition, since the lengths of the central portions are smaller than the lengths of the sides, the amount of the electrode paste is small at the central portions. Thus, since the electrode component is unlikely to be shifted to the central portions when the electrode paste is baked, the central portions of the first external electrode and the second external electrode are able to be made flat or substantially flat, and the adhesion to wire is able to be thus significantly increased. Thus, the reliability of wire bonding is able to be significantly increased.

The values of L1 and L2 have only to fall within a range in which the first external electrode and the second external electrode are not in contact with each other, and for example, L1 and L2 are preferably about 95 μm or more and about 285 μm or less, and more preferably about 200 μm or more about 255 μm or less. On the other hand, E1 and E2 may preferably be about 100 μm or more and about 290 μm or less, and more preferably about 205 μm or more and about 260 μm or less, for example. Within this range, the thermistor element is able to be used as, for example, a thermistor element that has a 0603 size in accordance with JIS and a thermistor element that has a size smaller than the 0603 size.

Further, for example, L1 and E1 and L2 and E2 preferably satisfy the relationships of about 0.770≤(L1/E1)≤about 0.975 and about 0.770≤(L2/E2)≤about 0.975, respectively. It is possible to prevent the first external electrode and the second external electrode from being in contact with each other, while the flatness of the first external electrode and the second external electrode being ensured.

Further, as shown in FIG. 5, preferably, adjacent corners 141*h*, 141*i* of the first external electrode 41 adjacent to or in a vicinity of the first end surface 15 have a round shape, and adjacent corners 141*h*, 141*i* of the second external electrode 42 adjacent to or in a vicinity of the second end surface 16 have a round shape, for example. The corners 141*h*, 141*i* have a round shape, thus significantly reducing or preventing the corners from cracking or chipping.

Figure 6:
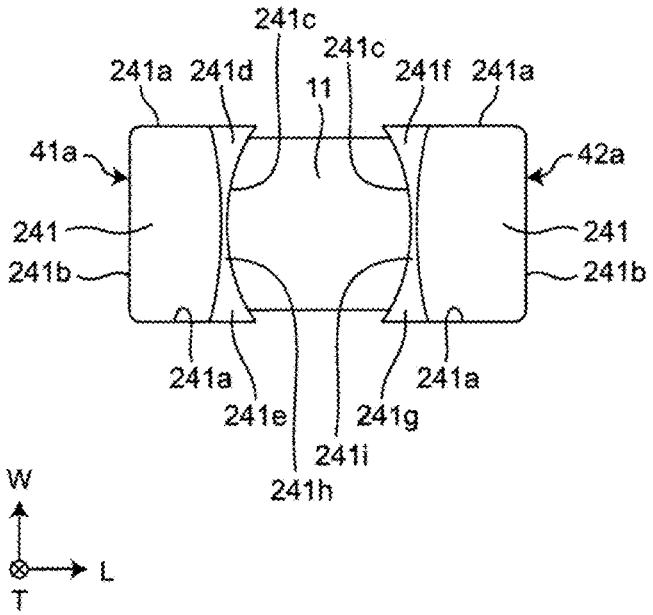
FIG. 6 is a plan view of a thermistor element according to still another preferred embodiment of the present invention.
Figure 7:
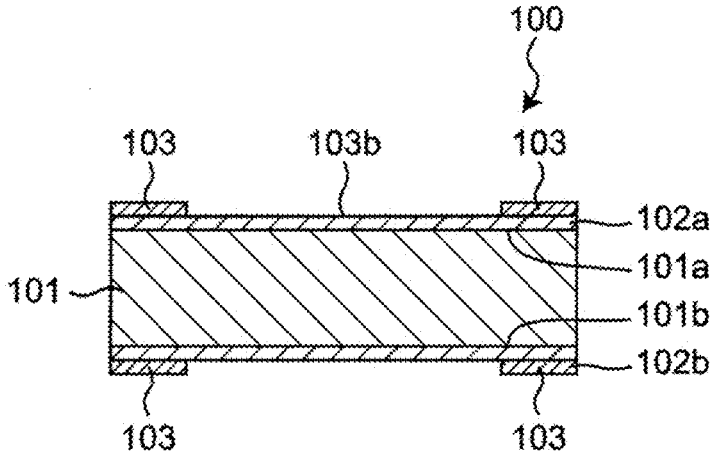
FIG. 7 PRIOR ART
FIG. 7 is a longitudinal sectional view showing an example of the structure of a conventional thermistor element.

Further, as shown in FIG. 6, the underlayer 41*a* of the first external electrode 41 is able to be provided with a thin first edge portion 241*h* connected to the two second external electrode side corner portions 241*d*, 241*e*, and the underlayer 42*a* of the second external electrode 42 is able to be provided with a thin second edge portion 241*i* connected to the two first external electrode side corner portions 241*f*, 241*g*. Accordingly, internal stress of the metal plating layer is able to be further absorbed, and peeling and cracking of the external electrode is able to be further significantly reduced or prevented. The same or similar thicknesses as those of the thin corner portions mentioned above are able to be applied to the thicknesses of the first edge portion and the second edge portion.

Next, a method for manufacturing the thermistor element will be described.

A preferred embodiment of the method for manufacturing the thermistor element includes an element body preparation step of preparing the element body; and an external electrode preparation step of preparing the first external electrode and the second external electrode, wherein the external electrode preparation step further includes an underlayer formation step of further forming underlayers, and the underlayer formation step includes forming thin portions at two second external electrode side corner portions, which are adjacent to each other, of the underlayer of the first external electrode adjacent to or in a vicinity of the second external electrode, and two first external electrode side corner portions, which are adjacent to each other, of the underlayer of the second external electrode adjacent to or in a vicinity of the first external electrode.

Element Body Preparation Step

First, ceramic materials are subjected to mixing and grinding to prepare a mixed powder, and the mixed powder is subjected to a calcination treatment to prepare a calcined powder. Thereafter, the calcined powder is formed into the shape of a sheet to prepare sheets, and the sheets and materials for the internal electrodes 21 and 22 are alternately laminated to form a laminated body. Thereafter, the laminated body is subjected to firing in a reducing atmosphere to prepare the element body 10 with the internal electrodes 21 and 22 provided therein. Chamfering, for example, barrel finishing, may be performed to chamfer the corner portions and ridges of the element body 10.

External Electrode Preparation Step

Thereafter, the first external electrode 41 and the second external electrode 42 are prepared through the formation of underlayers on the surface of the element body 10, and the formation of metal plating layers thereon by electrolytic plating. Thus, the thermistor element 1 is prepared.

In this regard, in the case of forming the underlayer, two second external electrode side corner portions, which are thin and adjacent to each other, of the underlayer of the first external electrode are formed adjacent to or in a vicinity of the second external electrode, and two first external electrode side corner portions, which are thin and adjacent to each other, of the underlayer of the second external electrode are formed adjacent to or in a vicinity of the first external electrode. The underlayers are able to be formed by a sputtering method, a vapor deposition method, a printing method, or a dipping method, for example, but the dipping method is preferred from the viewpoint of work efficiency. In the case of applying the dipping method, for example, adjustment of viscosity of the conductive paste or including a chamfered element body is able to increase a likelihood that the conductive paste flows to the peripheral edge portion of the first surface (except in the direction toward the opposed underlayer), thus enabling the first external electrode side corner portion and the second external electrode side corner portion to be thin while ensuring the flatness of the first surface. More specifically, the underlayers with the first external electrode side corner portions and second external electrode side corner portions made thinner are able to be integrally formed. In addition, in the case of applying the dipping method, there is a problem that when the conductive paste coating is subjected to sintering, the corners of the coating are likely to crack due to the sintering shrinkage of the coating, but when the first external electrode side corner portion and the second external electrode side corner portion are thin, the corner portions absorb a portion of the contraction stress, which also has the effect of significantly reducing or preventing crack generation.

In addition, the underlayer preparation step preferably further includes, for example, applying an electrode paste to the element body by the dipping method and baking the paste to prepare underlayers, and the lengths between pairs of end sides in the central portions of the underlayers of the first external electrode and the second external electrode are smaller than the lengths of the sides of the underlayers.

Specifically, to form the underlayers, the electrode paste is applied to the element body 10 by the dipping method, and baked to form the underlayers, and the lengths between pairs of end sides in the central portions of the underlayers of the first external electrode 41 and the second external electrode 42 are smaller than the lengths of the sides of the underlayers. In order to make the lengths between the pairs of end sides in the central portions of the underlayers smaller than the lengths of the sides of the underlayers, for example, a method is able to be used which increases a likelihood that the electrode paste flows to the peripheral edge portion, except in the direction toward the opposed underlayer. For example, a method that adjusts the viscosity of the electrode paste to adjust the fluidity of the electrode paste may be used. In addition, an element body subjected to chamfering may also be included. As compared with a case where chamfering is not performed, the applied electrode paste is made more likely to flow from the central portion of the element body to the peripheral edge portion, except in the direction toward the opposed underlayer. Thus, the lengths between the pairs of end sides in the central portions of the underlayers become smaller than the lengths of the sides of the underlayers, and flatter underlayers are able to be formed. In addition, the first end surface side corners and second end surface side corners of the underlayers are able to be adapted to have a round shape. Metal plating layers or the like are provided to maintain the shapes of the underlayers, thereby preparing the first external electrode and the second external electrode.

The present invention is not limited to the preferred embodiments described above, and various modifications and improvements can be made without departing from the scope of the present invention. For example, the thermistor element is an NTC thermistor in the preferred embodiments described above, but may be a PTC (Positive Temperature Coefficient) thermistor. Further, in the preferred embodiments described above, the cross section of the peripheral surface of the element body is tetragonal, but may be triangular or a polygon having more than four angles, or circular, elliptical, or oval, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A thermistor element comprising:

an element body made of a ceramic and including first and second end surfaces opposite to each other and a peripheral surface located between the first end surface and the second end surface;

a first external electrode covering the first end surface and a portion of the peripheral surface adjacent to or in a vicinity of the first end surface; and a second external electrode covering the second end surface and a portion of the peripheral surface adjacent to or in a vicinity of the second end surface; wherein each of the first external electrode and the second external electrode includes a plurality of electrode layers including an underlayer that is a lowermost layer and a metal plating layer that is an uppermost layer;

the underlayer of the first external electrode includes, adjacent to or in a vicinity of the second external electrode, two second external electrode side corner portions that are thin and adjacent to each other;

the underlayer of the second external electrode includes, adjacent to or in a vicinity of the first external electrode, two first external electrode side corner portions that are thin and adjacent to each other; and the uppermost layers cover each of the respective first and second external electrode side corner portions.

2. The thermistor element according to claim 1, wherein the underlayer of the first external electrode includes a thin first edge portion connected to the two second external electrode side corner portions, and the underlayer of the second external electrode includes a thin second edge portion connected to the two first external electrode side corner portions.

3. The thermistor element according to claim 1, wherein the underlayer includes a hardened conductive paste.

4. The thermistor element according to claim 1, wherein the first external electrode includes an arcuate recess where a central portion is recessed toward the first end surface in plan view, and the second external electrode includes an arcuate recess where a central portion is recessed toward the second end surface in plan view.

5. The thermistor element according to claim 1, wherein each of the first external electrode and the second external electrode includes, in plan view, a pair of end sides that intersect a length direction extending from the first end surface toward the second end surface and a pair of sides along the length direction, and relationships of $L1<E1$ and $L2<E2$ are satisfied, where L1 and L2 respectively denote lengths between the pairs of end sides in the central portions of the first external electrode and the second external electrode, and E1 and E2 respectively denote lengths of the sides of the first external electrode and the second external electrode.

6. The thermistor element according to claim 5, wherein L1 and L2 are about 95 μm or more and about 285 μm or less, and E1 and E2 are about 100 μm or more and about 290 μm or less.

7. The thermistor element according to claim 5, wherein L1 and E1 and L2 and E2 respectively satisfy relationships of about $0.770 \leq (L1/E1) \leq$ about 0.975 and about $0.770 \leq (L2/E2) \leq$ about 0.975.

8. The thermistor element according to claim 1, wherein adjacent corners of the first external electrode adjacent to or in a vicinity of the first end surface have a round shape, and adjacent corners of the second external electrode adjacent to or in a vicinity of the second end surface have a round shape.

9. The thermistor element according to claim 1, further comprising:

a first internal electrode included in the element body and electrically connected to the first external electrode; and a second internal electrode included in the element body and electrically connected to the second external electrode.

10. The thermistor element according to claim 9, wherein the element body includes a plurality of ceramic layers; and the first and second internal electrodes and the plurality of ceramic layers are laminated alternately.

11. The thermistor element according to claim 9, wherein one end of the first internal electrode is exposed at the first end surface; and one end of the second internal electrode is exposed at the second end surface.

12. The thermistor element according to claim 1, further comprising an intermediate layer provided between the underlayer and the metal plating layer.

13. The thermistor element according to claim 1, wherein an average thickness of the first and second external electrode side corner portions is about 1 μm or more and about 10 μm or less; and an average thickness of the underlayer of the first and external electrodes other than the first and second external electrode side corner portions is about 4 μm or more and about 14 μm or less.

14. A method for manufacturing a thermistor element including:

an element body made of a ceramic and including first and second end surfaces opposite to each other and a peripheral surface located between the first end surface and the second end surface;

a first external electrode covering the first end surface and a portion of the peripheral surface adjacent to or in a vicinity of the first end surface; and a second external electrode covering the second end surface and a portion of the peripheral surface adjacent to or in a vicinity of the second end surface, the method comprising:

an element body preparation step of preparing the element body; and an external electrode preparation step of preparing the first external electrode and the second external electrode; wherein the external electrode preparation step further includes an underlayer formation step of further forming underlayers;

the underlayer formation step includes forming two second external electrode side corner portions, which are thin and adjacent to each other, of the underlayer of the first external electrode adjacent to or in a vicinity of the second external electrode, and forming two first external electrode side corner portions, which are thin and adjacent to each other, of the underlayer of the second external electrode adjacent to or in a vicinity of the first external electrode; and the external electrode preparation step further includes forming uppermost layers that cover each of the respective first and second external electrode side corner portions.

15. The method according to claim 14, wherein the underlayer of the first external electrode is provided with a thin first edge portion connected to the two second external electrode side corner portions, and the underlayer of the second external electrode is provided with a thin second edge portion connected to the two first external electrode side corner portions.

16. The method according to claim 14, wherein the underlayer formation step includes applying an electrode paste to the element body by a dipping process, and baking the electrode paste to form the underlayers.

17. The method according to claim 14, wherein the underlayer formation step includes applying an electrode paste to the element body by a dipping process, and baking the electrode paste to form the underlayers; and lengths between pairs of end sides in central portions of the underlayers of the first external electrode and the second external electrode are smaller than lengths of sides of the underlayers.

* * * * *